US011998121B2

(12) United States Patent
Park

(10) Patent No.: US 11,998,121 B2
(45) Date of Patent: Jun. 4, 2024

(54) MEMBER FOR CHAIR INCLUDING MULTI-CHANNEL SOUND SYSTEM AND CHAIR INCLUDING THE MEMBER

(71) Applicant: TROUND INC., Hanam-si (KR)

(72) Inventor: Jea Bum Park, Namyangju-si (KR)

(73) Assignee: TROUND INC., Hanam-si (KR)

( * ) Notice: Subject to any disclaimer, the term of this patent is extended or adjusted under 35 U.S.C. 154(b) by 831 days.

(21) Appl. No.: 16/984,684

(22) Filed: Aug. 4, 2020

(65) Prior Publication Data

US 2021/0127841 A1 May 6, 2021

Related U.S. Application Data

(63) Continuation of application No. PCT/KR2020/008213, filed on Jun. 24, 2020.

(30) Foreign Application Priority Data

Oct. 30, 2019 (KR) ..... 10-2019-0136009
Jan. 10, 2020 (KR) ..... 10-2020-0003644

(51) Int. Cl.
*A47C 7/72* (2006.01)

(52) U.S. Cl.
CPC ..... *A47C 7/727* (2018.08)

(58) Field of Classification Search
CPC ..... A47C 7/727; H04R 1/02; H04R 1/026; H04R 1/028; H04R 1/345
See application file for complete search history.

(56) References Cited

U.S. PATENT DOCUMENTS

| | | | | |
|---|---|---|---|---|
| 4,075,438 | A | 2/1978 | Kappel | |
| 5,889,875 | A * | 3/1999 | Caron | A47C 7/727 381/345 |
| 6,744,898 | B1 * | 6/2004 | Hirano | H04R 5/023 381/301 |
| 2008/0164737 | A1 * | 7/2008 | Fowlds | A47C 7/006 297/284.4 |
| 2011/0051962 | A1 | 3/2011 | Cochran | |
| 2011/0081038 | A1 | 4/2011 | Tracy | |

(Continued)

FOREIGN PATENT DOCUMENTS

| | | | |
|---|---|---|---|
| CN | 206623779 | U | 11/2017 |
| CN | 209252144 | U | 8/2019 |
| CN | 209472760 | U | 10/2019 |

(Continued)

OTHER PUBLICATIONS

The extended European search report issued by the European Patent Office on Mar. 9, 2021, which corresponds to European Application No. 20203396.5-1207 and is related to U.S. Appl. No. 16/984,684.

(Continued)

*Primary Examiner* — Jason R Kurr
(74) *Attorney, Agent, or Firm* — Studebaker & Brackett PC

(57) ABSTRACT

The present invention relates to a member for a chair including a multi-channel sound system and a chair including the member, and more particularly, to a member for a chair including a multi-channel sound system, the member capable of providing a sense of space and a three-dimensional effect for a user who sits in the chair through sounds output from a plurality of channels, and a chair including the member.

16 Claims, 9 Drawing Sheets

(56) References Cited

U.S. PATENT DOCUMENTS

| | | | | |
|---|---|---|---|---|
| 2018/0201373 | A1* | 7/2018 | Tracy | B64D 11/00154 |
| 2018/0310086 | A1 | 10/2018 | Tracy | |

FOREIGN PATENT DOCUMENTS

| | | | |
|---|---|---|---|
| GB | 2 300 329 | A | 10/1996 |
| JP | S63-270260 | A | 11/1988 |
| JP | 2003-125475 | A | 4/2003 |
| JP | 2005-027019 | A | 1/2005 |
| JP | 2009-017278 | A | 1/2009 |
| JP | 2012-502513 | A | 1/2012 |
| JP | 2018-094179 | A | 6/2018 |
| KR | 10-1995-0702135 | A | 6/1995 |
| KR | 10-1997-0055889 | A | 7/1997 |
| KR | 20-0172149 | Y1 | 3/2000 |
| KR | 20-0302790 | Y1 | 2/2003 |
| KR | 20-0316013 | Y1 | 6/2003 |
| KR | 20-0324956 | Y1 | 8/2003 |
| KR | 10-2003-0088330 | A | 11/2003 |
| KR | 10-2004-0026541 | A | 3/2004 |
| KR | 10-2006-0117256 | A | 11/2006 |
| KR | 10-2008-0031709 | A | 4/2008 |
| KR | 20-2009-0008102 | U | 8/2009 |
| KR | 10-2011-0102660 | A | 9/2011 |
| KR | 10-1218027 | B1 | 1/2013 |
| KR | 10-2013-0037104 | A | 4/2013 |
| KR | 10-2013-0063906 | A | 6/2013 |
| KR | 10-2014-0138848 | A | 12/2014 |
| KR | 10-1477709 | B1 | 12/2014 |
| KR | 10-2016-0044631 | A | 4/2016 |
| TW | 201831160 | A | 9/2018 |

OTHER PUBLICATIONS

An Office Action issued by the Taiwanese Patent Office on Apr. 7, 2021, which corresponds to Taiwanese Patent Application No. 109135771 and is related to U.S. Appl. No. 16/984,684.

An Office Action issued by the Canadian Intellectual Property Office on May 13, 2022, which corresponds to Canadian Patent Application No. 3,156,094 and is related to U.S. Appl. No. 16/984,684.

* cited by examiner

MEMBER FOR CHAIR INCLUDING MULTI-CHANNEL SOUND SYSTEM AND CHAIR INCLUDING THE MEMBER

CROSS-REFERENCE TO RELATED APPLICATION

The present application is a continuation of International Patent Application No. PCT/KR2020/008213, field on 24 Jun. 2020, which is based upon and claims the benefit of priority to Korean Patent Application No. 10-2019-0136009, filed on Oct. 30, 2019, and Korean Patent Application No. 10-2020-0003644, filed on Jan. 10, 2020. The disclosures of the above-listed applications are hereby incorporated by reference herein in their entirety.

BACKGROUND

1. Field of the Invention

The present invention relates to a member for a chair including a multi-channel sound system and a chair including the member, and more particularly, to a member for a chair including a multi-channel sound system, the member capable of providing a sense of space and a three-dimensional effect for a user who sits in the chair through sounds output from a plurality of channels, and a chair including the member.

2. Discussion of Related Art

In general, a speaker used while being connected to a computer generates sound by converting a current flowing through a wire into an electrical signal and a vibration signal and generating vibrations using a vibration portion.

For example, when watching a movie or playing a game using a computer, a user not only watches images on a screen of the computer but also listens to sounds due to an electrical signal being transferred and vibrations generated by a speaker corresponding to the images being transferred to ears of the user while the user sits in a chair where a monitor of the computer is seen.

Particularly, a multi-channel sound system including a plurality of such speakers has an advantage of allowing a user to more exquisitely experience a direction & volume level of sounds in a movie.

However, in order to implement such multi-channel sound systems, it is necessary to provide a plurality of speakers above and below a desk, behind a chair, and the like and to electrically connect all of the plurality of speakers such that there is a great restriction in space.

Also, although a multi-channel sound system is implemented by arranging the plurality of speakers, there is a problem that a position of the chair is changed or a variety of physical interferences are present between the speakers and the user who sits in the chair.

As a related art, Korean Patent Application No. 10-2014-0138848 discloses a chair-type massage apparatus with a multi-channel sound system.

According to the related art, there is disclosed a chair-type massage apparatus including a seat portion, a footrest portion, a backrest portion, and armrest portions. The apparatus includes a central speaker disposed on a front end of the seat portion and configured to move between an initial position and a listening position to be inserted or protrude in response to a sitting operation or a departure operation of a user, a pair of front speakers disposed on front ends of the armrest portions on left and right sides of the seat portion and configured to move between an initial position and a listening position to be inserted or protrude in response to the sitting operation or the departure operation of the user, a pair of rear speakers disposed on left and right sides of a top end of the backrest portion, and a multi-channel audio output portion configured to apply corresponding audio signals to a plurality of such speakers. The audio output portion detects a body shape of the user in a seated state on the seat portion, calculates an original listening point of the user using detected body shape information, calculates a distance between the calculated original listening point and each of the speakers, and adjusts a volume level or a time-delay amount of an audio signal applied to each of the speakers on the basis of the calculated distance so as to generate three-dimensional sound.

However, even in the case of the chair-type massage apparatus, positions in which the speakers outputting sounds are provided are fixed to the left and right sides of the top end of the backrest portion and the front ends of the armrest portions on the left and right sides of the seat portion such that there is a limitation that it is impossible to precisely adjust the speakers.

Accordingly, the chair-type massage apparatus merely satisfies the number of the speakers as 5.1 channels, and accordingly, it is difficult to determine that directions, volume levels, and the like of sounds in images are vividly transferred to the user.

SUMMARY OF THE INVENTION

The present invention is directed to providing a member for a chair in which a multi-channel sound system is implemented, the member capable of being installed in a headrest portion of the chair or a part at which the headrest portion is connected to a backrest portion or of replacing the headrest portion.

The present invention is directed to providing a chair in which a member for a chair, in which a multi-channel sound system is implemented, is installed in at least one selected from 1) a headrest portion configured to support a head part of a user, 2) a backrest portion configured to support a back and waist part of the user, and 3) a seat portion configured to support a buttocks part and part of legs of the user.

According to one aspect of the present invention, there is provided a member for a chair. The member includes a fixing portion, a first speaker mounting member provided to extend in one direction of the fixing portion and in which at least one speaker is installed, and a second speaker mounting member provided to extend in the other direction of the fixing portion and in which at least one speaker is installed. Here, the speakers installed in the first speaker mounting member and the second speaker mounting member receive a multi-channel sound signal and implement a multi-channel sound system.

According to another aspect of the present invention, there is provided a chair including at least 1) a headrest portion configured to support a head part of a user, 2) a backrest portion configured to support a back and waist part of the user, and 3) a seat portion configured to support a buttocks part and part of legs of the user. Here, a member for a chair is installed in at least one selected from the headrest portion, the backrest portion, and the seat portion to receive a multi-channel sound signal and implement a multi-channel sound system.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, a member for a chair including a multi-channel sound system and a chair including the same according to some embodiments of the present invention will be described in detail.

Figure 1:
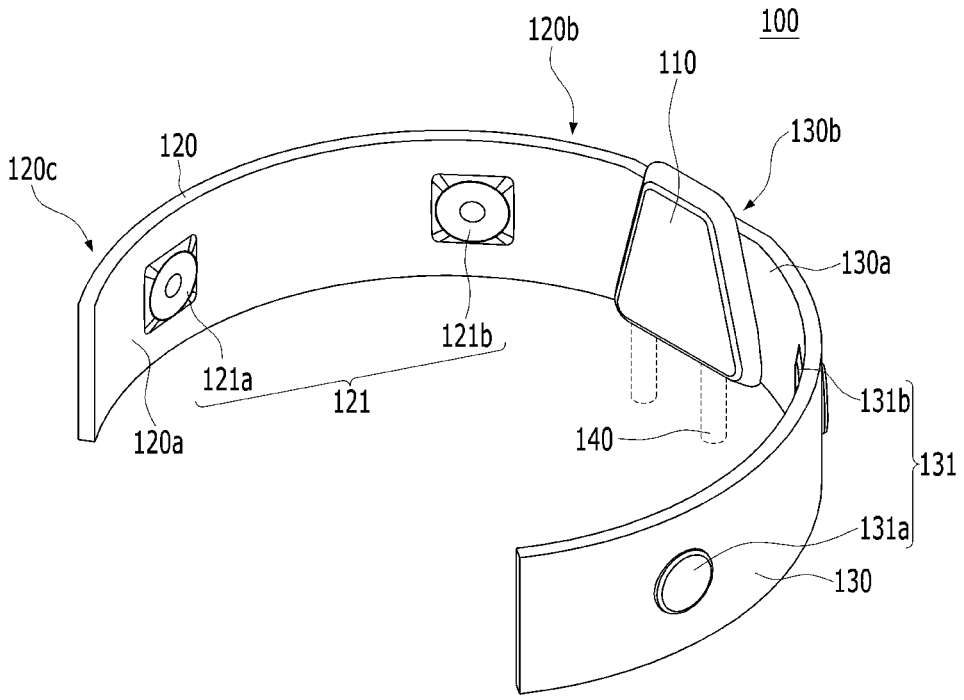
FIG. 1 is a perspective view of a member for a chair according to one embodiment of the present invention.

FIG. 1 is a perspective view of a member for a chair according to one embodiment of the present invention.

Referring to FIG. 1, a member 100 for a chair according to one embodiment of the present invention includes a fixing portion 110, a first speaker mounting member 120 configured to extend in one direction from the fixing portion 110 and to have an inside 120*a* on which at least one speaker 121 is installed, and a second speaker mounting member 130 configured to extend in the other direction from the fixing portion 110 and to have an inside 130*a* on which at least one speaker 131 is installed.

For example, the fixing portion 110 may function as a portion configured to fixedly install the member 100 to a headrest portion of the chair or a part at which the headrest portion is connected to a backrest portion of the chair or may replace the headrest portion. When the fixing portion 110 replaces the headrest portion, a front or inside of the fixing portion 110 (that is, a direction in which a sound is output from the speakers 121 or 131) may be formed of a cushioning material or have the cushioning material added thereon for comfort of a user who sits in the chair.

The first speaker mounting member 120 having a shape extending in one direction of the fixing portion 110 (in a right direction of the user sitting in the chair) is provided on one side of the fixing portion 110 (in the right direction of the user sitting in the chair). The at least one speaker 121 may be installed in front of the first speaker mounting member 120 or on the inside 120*a*. When at least two speakers 121*a* and 121*b* are installed on the inside 120*a* of the first speaker mounting member 120, the two speakers 121*a* and 121*b* may be installed to be spaced at a certain interval apart from each other, from one end 120*b* of the first speaker mounting member 120, which is fixed to the fixing portion 110, toward the other end 120*c* of the first speaker mounting member 120, which is not fixed to the fixing portion 110.

Likewise, the second speaker mounting member 130 having a shape extending in the other direction of the fixing portion 110 (in a left direction of the user sitting in the chair) is provided on the other side of the fixing portion 110 (in the left direction of the user sitting in the chair). The at least one speaker 131 may be installed in front of the second speaker mounting member 130 or on the inside 130*a*. When at least two speakers 131*a* and 131*b* are installed on the inside 130*a* of the second speaker mounting member 130, the two speakers 131*a* and 131*b* may be installed to be spaced at a certain interval apart from each other, from one end 130*b* of the second speaker mounting member 130, which is fixed to the fixing portion 110, toward the other end 130*c* of the second speaker mounting member 130, which is not fixed to the fixing portion 110.

Meanwhile, the speakers may be speaker units connected to driving portions separately provided at the first speaker mounting member 120 and the second speaker mounting member 130 and configured to operate as a complete product, independently-operable speaker units, multi-way speakers, display type speakers, or thin-film type speakers. The speakers may operate through wires or operate wirelessly.

The fixing portion 110, the first speaker mounting member 120, and the second speaker mounting member 130 may be separately provided or integrally provided.

In one embodiment, the one end 120*b* of the first speaker mounting member 120 and the one end 130*b* of the second speaker mounting member 130 may be fixedly installed on both sides of the fixing portion 110. The other end 120*c* of the first speaker mounting member 120 and the other end 130*c* of the second speaker mounting member 130, which are not fixed to the fixing portion 110, may be configured to tilt toward the front or inside of the fixing portion 110.

As described above, the other end 120*c* of the first speaker mounting member 120 and the other end 130*c* of the second speaker mounting member 130, which are not fixed to the fixing portion 110, are configured to tilt toward the front or inside of the fixing portion 110 so that sounds output from a plurality of such speakers 121 and 131 installed on the first speaker mounting member 120 and the second speaker mounting member 130 may be further concentrated on the user.

Also, it is possible to maintain a constant distance between the user, who sits in the chair in which the member 100 is installed, and the plurality of speakers 121 and 131.

Here, the first speaker mounting member 120 and the second speaker mounting member 130 may have a linear shape, an angular shape, or a curved shape while the other end 120*c* of the first speaker mounting member 120 and the other end 130*c* of the second speaker mounting member 130, which are not fixed to the fixing portion 110, may be aligned to tilt toward the front or inside of the fixing portion 110.

In another embodiment, the one end 120*b* of the first speaker mounting member 120 and the one end 130*b* of the second speaker mounting member 130 may be fixedly installed on both sides of the fixing portion 110. A surface of the inside 120*a* of the first speaker mounting member 120 and a surface of the inside 130*a* of the second speaker mounting member 130 may be configured to tilt toward the front or inside of the fixing portion 110. In this case, since it is necessary only to form the surface of the inside 120*a* of the first speaker mounting member 120 and the surface of the inside 130*a* of the second speaker mounting member 130, on which the plurality of speakers 121 and 131 are installed, to be tilted, a possibility of modifying shapes of the first speaker mounting member 120 and the second speaker mounting member 130 may be improved.

As described above, the first speaker mounting member 120 and the second speaker mounting member 130, which are installed to extend from both sides of the fixing portion 110, and the plurality of speakers 121 and 131 installed on the first speaker mounting member 120 and the second speaker mounting member 130 may implement a multi-channel sound system by receiving and outputting a multi-channel sound signal from a sound source (for example, a home theater, TV, a set-top box, a sound bar, a computer, a cellular phone, a tablet PC, or the like) provided inside or outside the chair.

In still another embodiment, the one end 120*b* of the first speaker mounting member 120 and the one end 130*b* of the second speaker mounting member 130 may be hinge-pivotably installed on the fixing portion 110.

In this case, when the user sits in or rises from the chair in which the member 100 is installed, directions of the first speaker mounting member 120 and the second speaker mounting member 130 may be adjusted not to interfere. In another case, directions of the first speaker mounting member 120 and the second speaker mounting member 130 may be manually adjusted by the user or be autonomously adjusted through an additional algorithm so as to create further optimized and customized sound environments while the user sits in the chair.

Also, the member 100 may selectively include a coupling portion 140 configured to couple the fixing portion 110 to the chair.

The coupling portion 140 is configured to install the member 100 on at least one position of the chair selected from 1) the headrest portion configured to support the heat part of the user, 2) the backrest portion configured to support the back and waist part of the user, and 3) a seat portion configured to support a buttocks part and a part of legs of the user.

In one embodiment, when the member 100 is installed in the front or rear of the headrest portion or backrest portion, the coupling portion 140 may be fixedly installed in the chair using a variety of well-known coupling devices. In another case, a fastening portion (not shown) corresponding to the coupling portion 140 may be additionally provided in the chair.

Also, in another embodiment, the member 100 may be integrally provided with the headrest portion or may replace the headrest portion. When the member 100 replaces the headrest portion, the member 100 may be coupled, instead of the headrest portion, to a position of the backrest portion, at which the headrest portion is coupled, with the coupling portion 140 as a medium.

Figure 2:
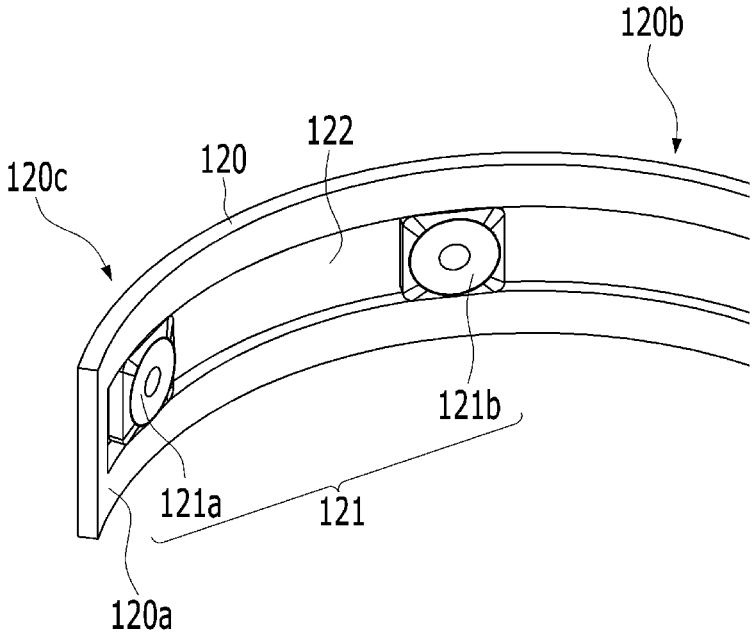
FIGS. 2 to 4C illustrate another modified example of the member shown in FIG. 1.
Figure 3A:
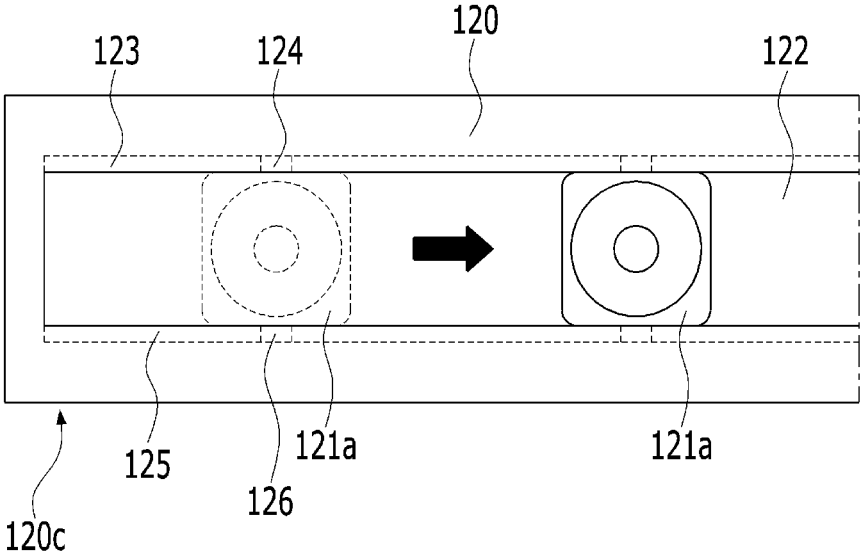
Figure 3B:
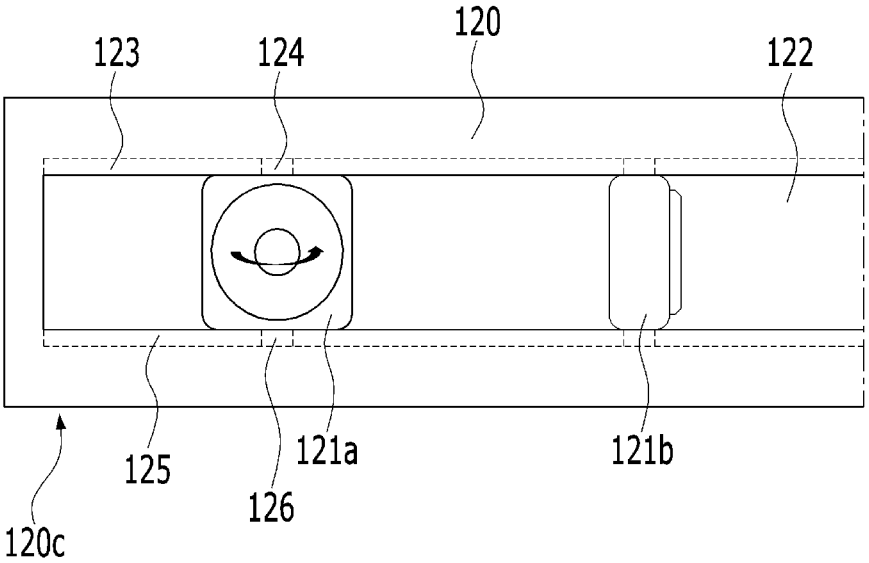

FIGS. 2 to 3B illustrate another modified example of the member 100 shown in FIG. 1. Although FIGS. 2 to 3B, for convenience, illustrate only the first speaker mounting member 120, it should be understood that the content to be described with reference to FIGS. 2 to 3B is applicable equally to the second speaker mounting member 130. Also, likewise, the content to be described with reference to FIGS. 2 to 3B is applicable equally to a third speaker mounting member and an auxiliary speaker mounting member which will be described below.

Referring to FIGS. 2 to 3B, the at least one speaker 121 installed in the first speaker mounting member 120 may be installed to be slidably movable along a direction in which the first speaker mounting member 120 extends. Accordingly, there is an advantage that each user may be allowed to customize a sound system for himself or herself by adjusting a position of the at least one speaker 121 installed in the first speaker mounting member 120.

In detail, a slide space 122 having a shape bent along the direction in which the first speaker mounting member 120 extends may be formed in the surface of the inside 120*a* of the first speaker mounting member 120. The at least one speaker 121 may be installed in the slide space 122. The slide space 122 may be formed to pass through the first speaker mounting member 120 but formed such that an outer surface of the first speaker mounting member 120 is blocked.

Referring to FIG. 3A, sliding rails 123 and 125 may be provided selectively above and/or below the slide space 122. Sliding members 124 and 126 provided above and/or below the speaker 121*a* installed in the slide space 122 are installed on the slide rails 123 and 125 to be slidably movable. The speaker 121*a* may be slidably movable along the direction in which the first speaker mounting member 120 extends while being stably supported by the slide rails 123 and 125 and additionally in the slide space 122 by the sliding members 124 and 126. Meanwhile, the slide rails 123 and 125 may be installed on a side surface of the slide space 122.

Meanwhile, referring to FIG. 3B, the slide members 124 and 126 may be provided as rotatable members so that the speaker 121*a* supported by the sliding rails 123 and 125 is rotatable on the basis of an axial direction.

Accordingly, the at least one speaker 121 installed in the first speaker mounting member 120 is slidably movable along the direction in which the first speaker mounting member 120 extends as well as being rotatable on the basis of the axial direction so as to implement more variable sound environments.

Figure 4A:
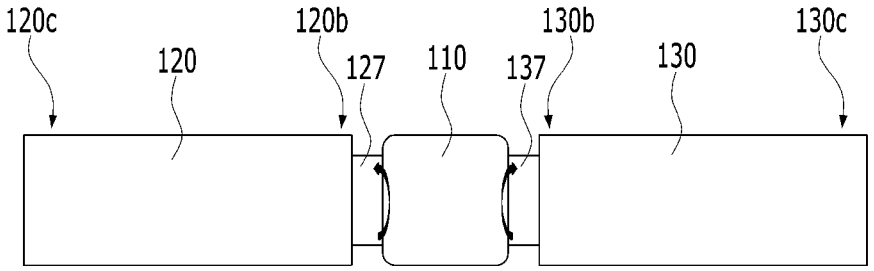
Figure 4B:
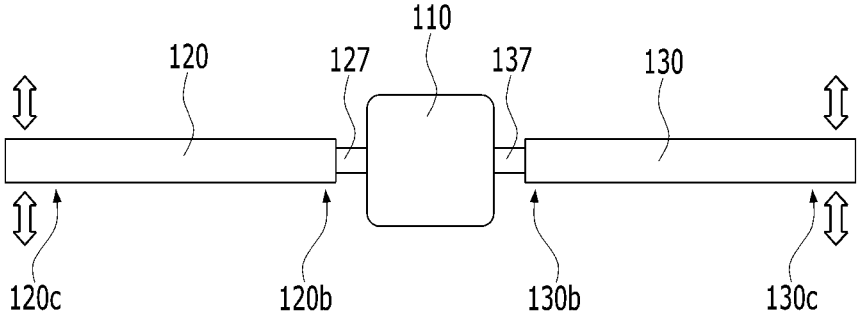
Figure 4C:
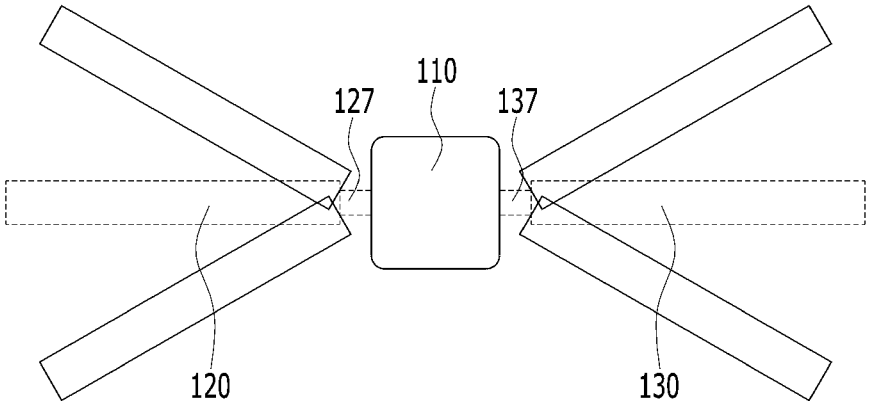

FIGS. 4A to 4C are schematic diagrams illustrating another modified example of the member 100 shown in FIG. 1.

Referring to FIGS. 4A to 4C, the one end 120*b* of the first speaker mounting member 120 and the one end 130*b* of the second speaker mounting member 130 may be hinge-pivotably installed on the fixing portion 110 with hinge portions 127 and 137 as media, respectively.

In this case, the first speaker mounting member 120 and the second speaker mounting member 130 are rotatable on the basis of extension directions thereof (refer to FIGS. 4A and 4B). Also, referring to FIG. 4C which illustrates a top surface of the member 100, the hinge portions 127 and 137 may allow the first speaker mounting member 120 and the second speaker mounting member 130 to be bendable forward or backward on the basis of the fixing portion 110.

Accordingly, when the user sits in or rises from the chair in which the member 100 is installed, directions and positions of the first speaker mounting member 120 and the second speaker mounting member 130 may be adjusted not to interfere. In another case, directions of the first speaker mounting member 120 and the second speaker mounting member 130 may be manually adjusted by the user or be autonomously adjusted through an additional algorithm so as to create further optimized and customized sound environments while the user sits in the chair.

Figure 5:
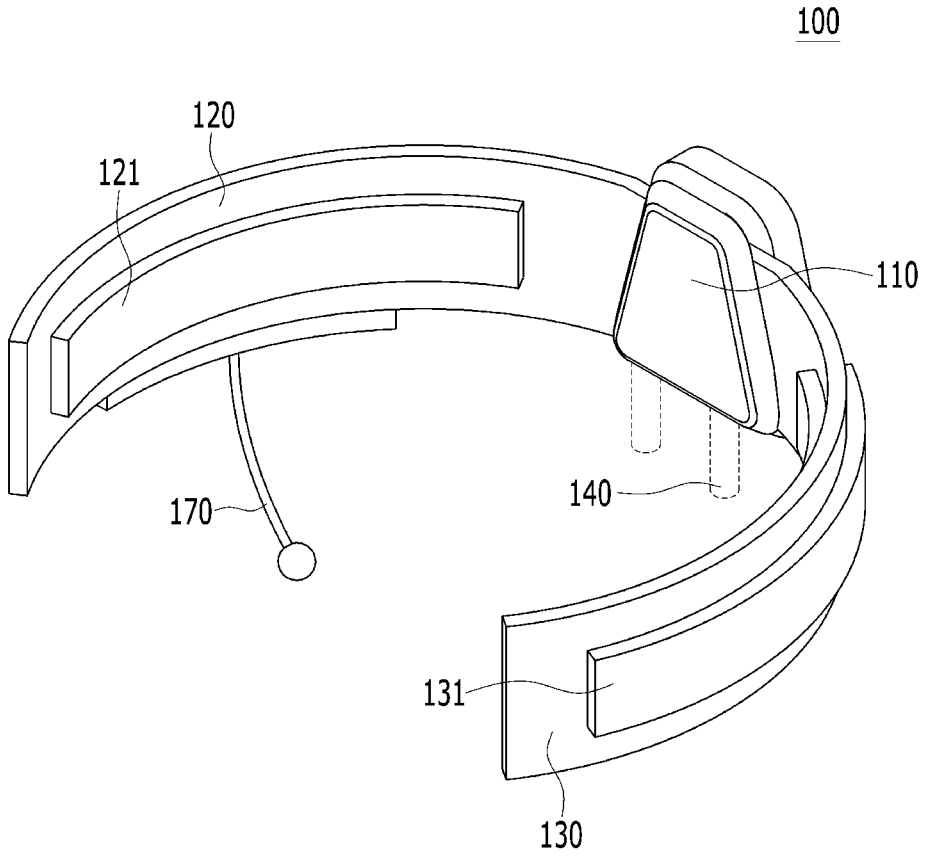
FIGS. 5 to 8 are perspective views of a member for a chair according to another embodiment of the present invention.

FIG. 5 is a perspective view of a member for a chair according to another embodiment of the present invention.

Referring to FIG. 5, the speakers 121 and 131 installed on the inside 120*a* of the first speaker mounting member 120 and the inside 130*a* of the second speaker mounting member 130 may be film-type speakers or display-type speakers. Particularly, when the speakers 121 and 131 are display-type speakers, a variety of user experiences may be provided to the user who sits in the chair in which the member 100 is installed.

Since the film-type speakers generally output sounds through 'a surface output method" unlike speakers which output sounds through "a point output method," it is possible to allow the user to feel a sense of space by three-dimensionally outputting a sound.

Also, the display-type speakers may generally function as auxiliary image sources configured to output additional images with a main image source (for example, a home theater, TV, a computer, a cellular phone, a tablet PC, and the like) disposed in front of the user who sits in the chair. In this case, it is possible to increase an immersion level of the user with respect to images or games.

In addition, a sound input portion 170 may be additionally provided on one part of the member 100 (for example, a bottom end of the first speaker mounting member 120). The sound input portion 170 may be implemented as a device such as a microphone which allows the user to input a voice or the like.

Figure 6:
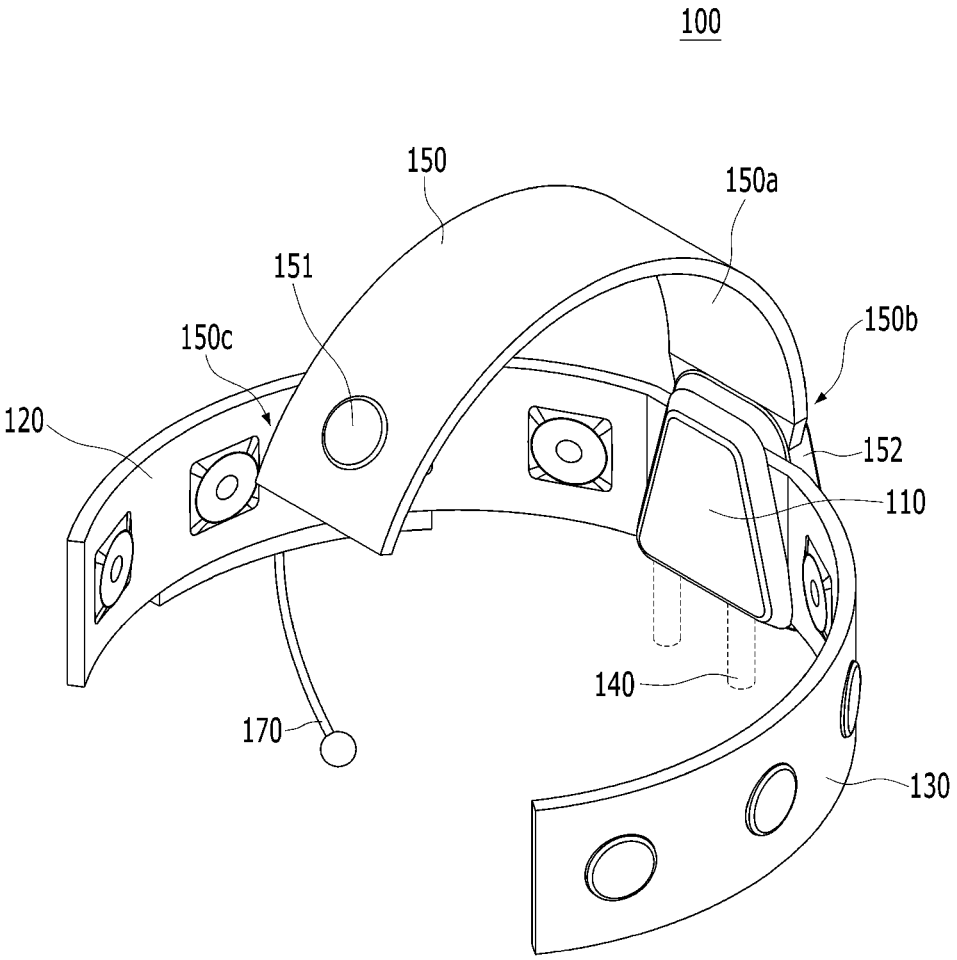
Figure 7:
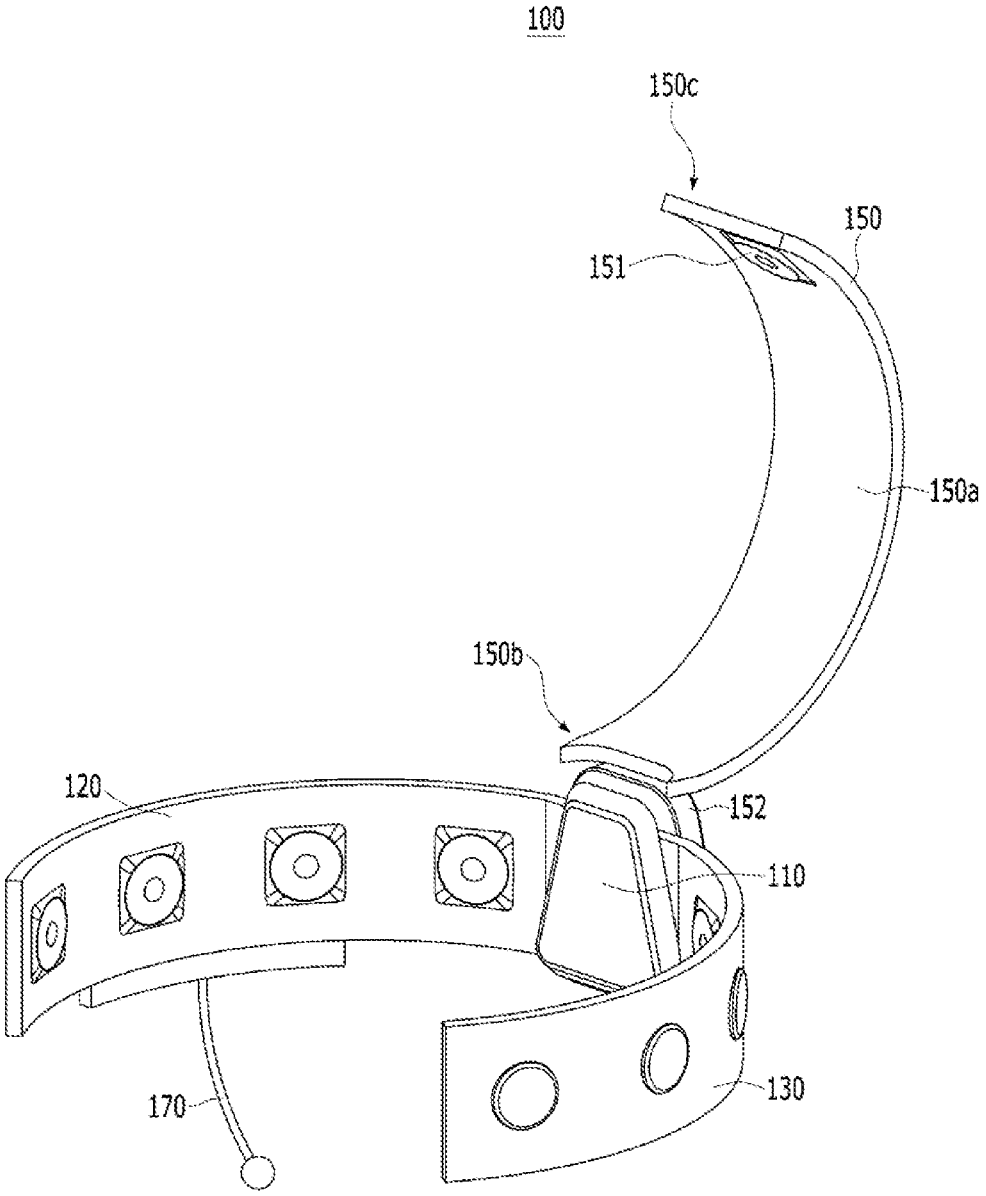

FIGS. 6 to 7 are perspective views of a member for a chair according to still another embodiment of the present invention.

Referring to FIGS. 6 and 7, a member 100 for a chair according to another embodiment of the present invention includes a fixing portion 110, a first speaker mounting member 120 configured to extend in one direction from the fixing portion 110 and to have an inside 120*a* on which at least one speaker 121 is installed, a second speaker mounting member 130 configured to extend in the other direction from the fixing portion 110 and to have an inside 130*a* on which at least one speaker 131 is installed, and at least one third speaker mounting member 150 formed to extend in an upper direction of the fixing portion 110 and to have an inside 150*a* on which at least one speaker 151 is installed.

Since the fixing portion 110, the first speaker mounting member 120, the second speaker mounting member 130, and other repetitive components have been described above, a description thereof will be omitted for convenience. Also, the fixing portion 110, the first speaker mounting member 120, the second speaker mounting member 130, and the third speaker mounting member 150 may be separately provided or integrally provided.

In the embodiment, the third speaker mounting member 150 having a shape extending in a forward direction of the fixing portion 110 (in a forward direction of the user sitting in the chair) is provided above the fixing portion 110 (in a direction toward the top of head of the user sitting in the chair). The at least one speaker 151 may be installed on the inside 150*a* of the third speaker mounting member 150. When at least two speakers 151 are installed on the inside 150*a* of the third speaker mounting member 150, the two speakers 151 may be installed to be spaced at a certain interval apart from each other, from one end 150*b* of the third speaker mounting member 150, which is fixed to the fixing portion 110, toward the other end 150*c* of the third speaker mounting member 150, which is not fixed to the fixing portion 110.

In one embodiment, the one end 150*b* of the third speaker mounting member 150 may be fixedly installed above the fixing portion 110 and the other end 150*c* of the third speaker mounting member 150, which is not fixed to the fixing portion 110, may be configured to tilt toward the front of the fixing portion 110.

As described above, the other end 150*c* of the third speaker mounting member 150, which is not fixed to the fixing portion 110, may be provided to tilt toward the front of the fixing portion 110 so as to further concentrate sounds output from the at least one speaker 151 installed on the third speaker mounting member 150 on the user.

Also, when a plurality of such speakers 151 are installed on the third speaker mounting member 150, since the other end 150*c* of the third speaker mounting member 150, which is not fixed to the fixing portion 110, may be provided to tilt toward the front of the fixing portion 110, it is possible to maintain a constant distance between the user, who sits in the chair in which the member 100 is installed, and the plurality of speakers 151 installed on the third speaker mounting member 150. Particularly, in this case, it is possible to maintain a constant distance between the user and the plurality of speakers 121 and 131 installed on the first speaker mounting member 120 and the second speaker mounting member 130 as well as maintaining a constant distance between the user and the speakers 151 installed on the third speaker mounting member 150.

Here, the third speaker mounting member 150 has a linear shape, an angular shape, or a curved shape while the other end 150*c* of the third speaker mounting member 150, which is not fixed to the fixing portion 110, may be disposed to tilt toward the front or inside of the fixing portion 110.

In another embodiment, the one end 150*b* of the third speaker mounting member 150 may be fixedly installed above the fixing portion 110 and a surface of the inside 150*a* of the third speaker mounting member 150 may be configured to tilt toward the front of the fixing portion 110. In this case, since it is necessary to form only the surface of the inside 150*a* of the third speaker mounting member 150, on which the at least one speaker 151 is installed, to be tilted, a possibility of modifying a shape of the third speaker mounting member 150 may be improved.

As described above, the third speaker mounting member 150 installed to extend above the fixing portion 110 and the at least one speaker 151 installed on the third speaker mounting member 150 may implement a multi-channel sound system by receiving and outputting a multi-channel sound signal from a sound source (home theater, TV, set-top box, sound bar, computer, cellular phone, tablet PC, or the like) provided inside or outside the chair.

In still another embodiment, the one end 150*b* of the third speaker mounting member 150 may be hinge-pivotably installed on the fixing portion 110 with a hinge portion 152 as a medium.

In this case, when the user sits in or rises from the chair in which the member 100 is installed, a direction of the third speaker mounting member 150 may be adjusted not to interfere. In another case, a direction of the third speaker mounting member 150 may be manually adjusted by the user or be autonomously adjusted through an additional algorithm so as to create further optimized and customized sound environments while the user sits in the chair.

Figure 8:
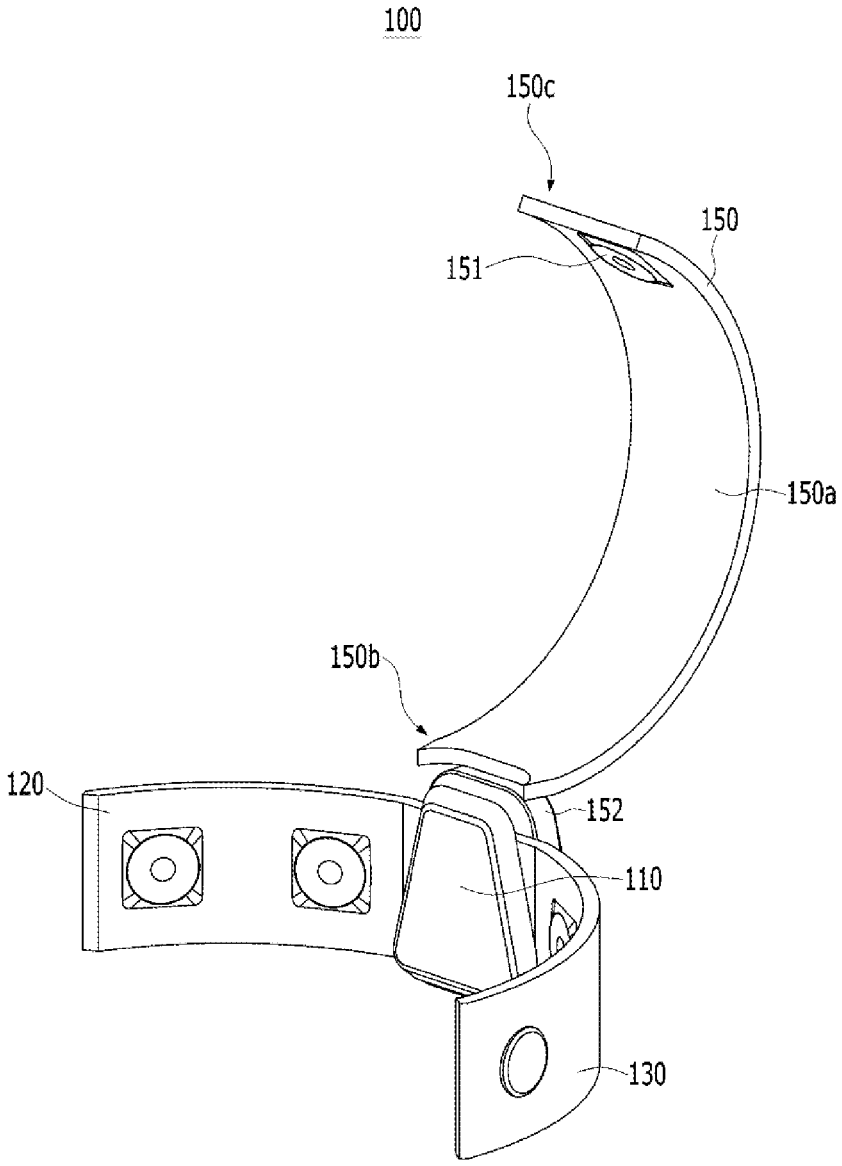

FIG. 8 is a perspective view of a member for a chair according to still another embodiment of the present invention.

Referring to FIG. 8, the first speaker mounting member 120 and the second speaker mounting member 130 may extend toward side surfaces of the face of the user (in detail, near ears of the user) who sits in the chair in which the member 100 is installed. Here, the first speaker mounting member 120 and the second speaker mounting member 130 may extend forward to have a linear, curved, or angular shape.

As described above, it is possible to implement a binaural effect of the multi-channel sound system by controlling extension lengths of the first speaker mounting member 120 and the second speaker mounting member 130.

Figure 9:
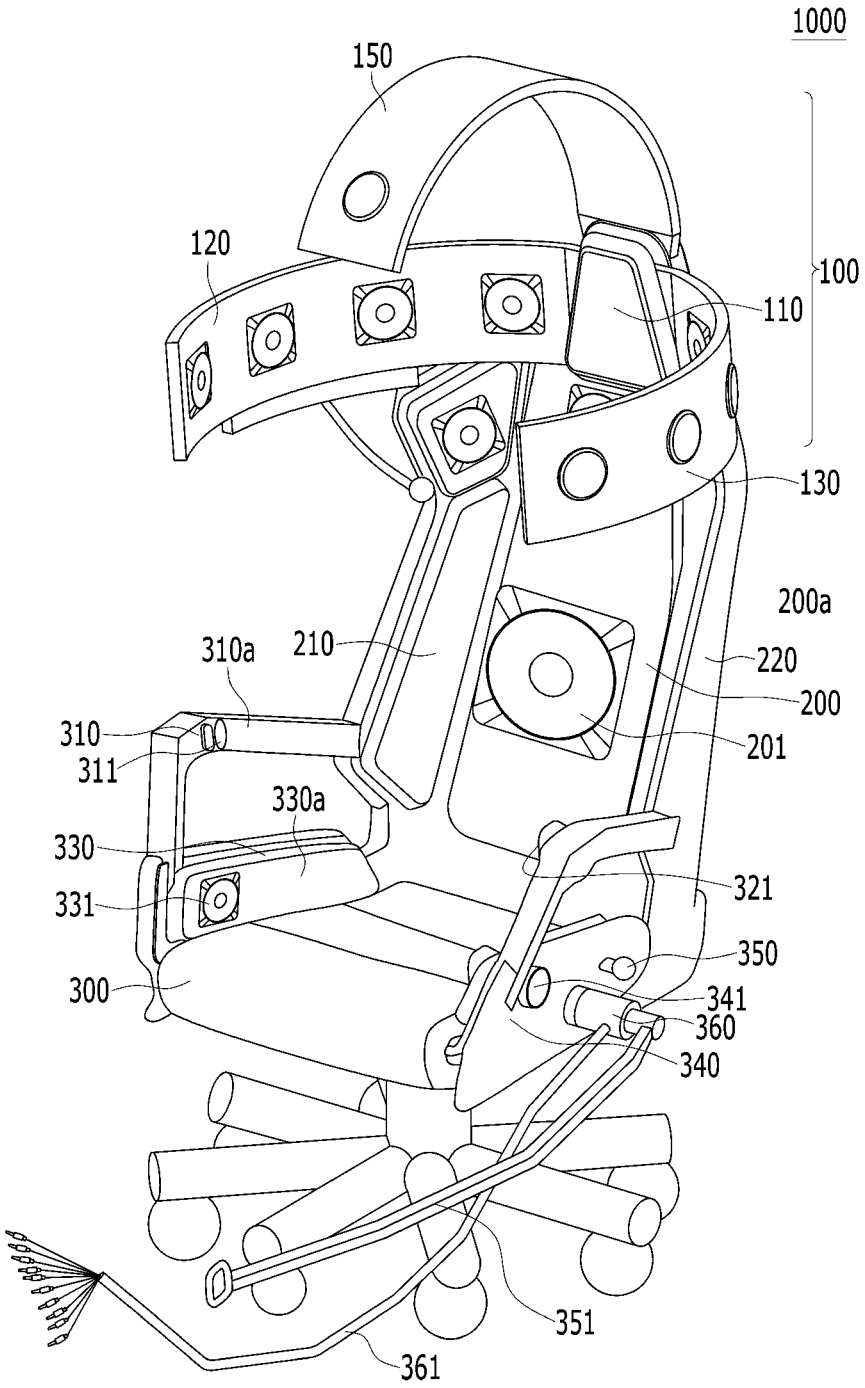
FIG. 9 is a perspective view of a chair according to one embodiment of the present invention.
Figure 10:
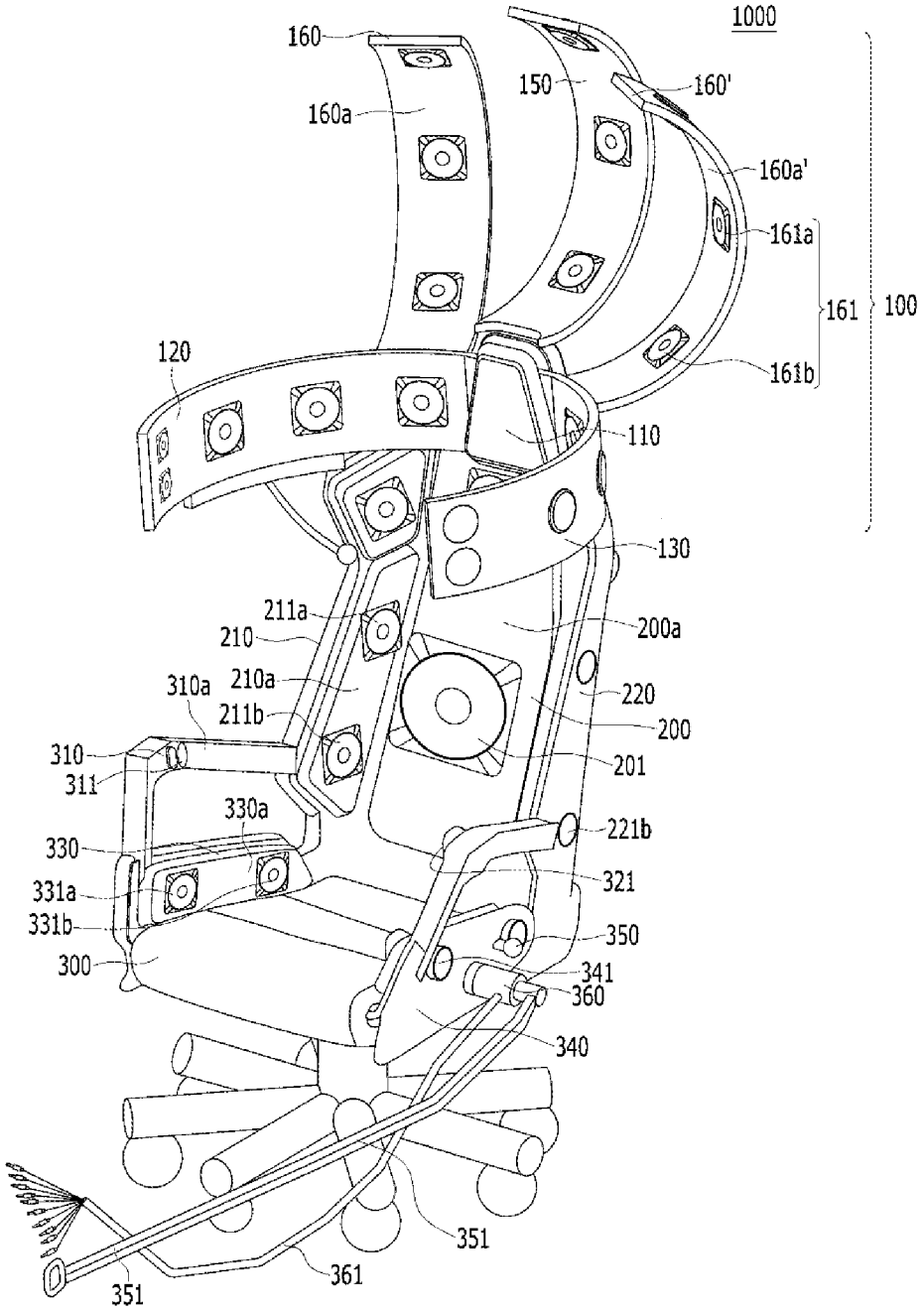
FIG. 10 is a perspective view of a chair according to another embodiment of the present invention.

FIGS. 9 and 10 are perspective views of a chair according to some embodiments of the present invention. FIGS. 9 and 10 illustrate an example of a chair 1000 in which the above member 100 for a chair including the multi-channel sound system replaces the headrest portion.

However, as described above, the chair 1000 according to the present invention should be construed as including a case in which the member 100 is installed or replaced on a headrest portion, a backrest portion, or a seat portion as well as a case in which the member 100 replaces the headrest portion.

Referring to FIGS. 9 and 10, the chair 1000 according to one embodiment of the present invention includes at least 1) the fixing portion 110 or headrest portion configured to support the head part of the user, 2) a backrest portion 200 configured to support the back and waist part of the user, and 3) a seat portion 300 configured to support a buttocks part and part of legs of the user.

Also, the chair 1000 is shown as a movable chair in FIGS. 9 and 10 but the chair 1000 according to the present invention may be provided as a fixed chair, such as sofa type chair.

The fixing portion 110 is a part which supports the head part of the user who sits in the chair 1000 and in which a front or inside (that is, a part which comes into contact with the head part of the user) may be formed of a cushioning material or have a cushioning material added thereon for comfort of the user.

Also, the member for the chair in which the multi-channel sound system is implemented may be fixedly installed on the front, rear, or another arbitrary area of the fixing portion 110 (for example, a part at which the fixing portion 110 is connected to the backrest portion 200). Here, the member for the chair may be fixedly installed on an arbitrary area of the chair using a well-known variety of fixing coupling methods such as screw-coupling, insertion-coupling, Velcro-coupling, clamp-coupling, and the like.

In another embodiment, the member 100 for the chair in which the multi-channel sound system is implemented may replace the headrest portion or the headrest portion may replace the fixing portion 110 of the member for the chair.

Also, according to still another embodiment of the present invention, although not shown in the drawing, the backrest portion 200 of the chair 1000 may replace the fixing portion 110 of the member for the chair. Accordingly, the first speaker mounting member 120 and the second speaker mounting member 130 may extend from both sides or rear side of the backrest portion 200.

As described above, hereinafter, a case in which the member for the chair in which the multi-channel sound system is implemented replaces the headrest portion, that is, a case in which the member for the chair and the headrest portion are integrated, will be described as a detailed example.

Accordingly, since the fixing portion 110, the first speaker mounting member 120, the second speaker mounting member 130, and other repetitive components, which are included in the headrest portion, have been described above, a description thereof will be omitted for convenience.

Referring to FIG. 10, the headrest portion includes the fixing portion 110, the first speaker mounting member 120 provided to extend in one direction of the fixing portion 110 and to have the inside 120*a* on which at least one speaker 121 is installed, the second speaker mounting member 130 provided to extend in the other direction of the fixing portion 110 and to have the inside 130*a* on which at least one speaker 131 is installed, the third speaker mounting member 150 provided to extend above the fixing portion 110 and to have the inside 150*a* on which at least one speaker 151 is installed, and at least one auxiliary speaker mounting member 160 or 160' in at least one area selected from a space between the first speaker mounting member 120 and the third speaker mounting member 150 and a space between the second speaker mounting member 130 and the third speaker mounting member 150.

In the embodiment, the auxiliary speaker mounting member 160 or 160' having a shape extending toward the front of the fixing portion 110 (in front of the user sitting in the chair) is provided in at least one area selected from the space between the first speaker mounting member 120 and the third speaker mounting member 150 and the space between the second speaker mounting member 130 and the third speaker mounting member 150. At least one speaker 161 may be installed on an inside 160*a* or 160*a'* of the auxiliary speaker mounting member 160 or 160'. When at least two speakers 161*a* and 161*b* are installed on the inside 160*a* or 160*a'* of the auxiliary speaker mounting member 160 or 160', the two speakers 161*a* and 161*b* may be installed to be spaced at a certain interval apart from each other, from one end of the auxiliary speaker mounting member 160 or 160', which is fixed to the fixing portion 110, toward the other end of the auxiliary speaker mounting member 160 or 160', which is not fixed to the fixing portion 110.

In one embodiment, the one end of the auxiliary speaker mounting member 160 or 160' may be fixedly installed above the fixing portion 110 and the other end of the auxiliary speaker mounting member 160 or 160', which is not fixed to the fixing portion 110, may be configured to tilt toward the front of the fixing portion 110.

As described above, the other end of the auxiliary speaker mounting member 160 or 160', which is not fixed to the fixing portion 110, may be provided to tilt toward the front of the fixing portion 110 so as to further concentrate sounds output from the at least one speaker 161 installed on the auxiliary speaker mounting member 160 or 160' on the user.

Also, when a plurality of such speakers 161 are installed on the auxiliary speaker mounting member 160 or 160', since the other end of the auxiliary speaker mounting member 160 or 160', which is not fixed to the fixing portion 110, may be provided to tilt toward the front of the fixing portion 110, it is possible to maintain a constant distance between the user, who sits in the chair 1000, and the plurality of speakers 161 installed on the auxiliary speaker mounting member 160 or 160'. Particularly, in this case, it is possible to maintain a constant distance between the user and the plurality of speakers 121, 131, and 151 installed on the first speaker mounting member 120, the second speaker mounting member 130, and the third speaker mounting member 150 as well as maintaining a constant distance between the user and the speakers 161 installed on the auxiliary speaker mounting member 160 or 160'.

Here, the auxiliary speaker mounting member 160 or 160' has a linear shape, an angular shape, or a curved shape while the other end of the auxiliary speaker mounting member 160 or 160', which is not fixed to the fixing portion 110, may be disposed to tilt toward the front or inside of the fixing portion 110.

In another embodiment, the one end of the auxiliary speaker mounting member 160 or 160' may be fixedly installed above the fixing portion 110 and a surface of the inside 160*a* or 160*a'* of the auxiliary speaker mounting member 160 or 160' may be configured to tilt toward the front of the fixing portion 110. In this case, since it is necessary to form only a surface of the surface of the inside 160*a* or 160*a'* of the auxiliary speaker mounting member 160 or 160', on which the at least one speaker 161 is installed, to be tilted, a possibility of modifying a shape of the auxiliary speaker mounting member 160 or 160' may be improved.

As described above, the auxiliary speaker mounting member 160 or 160' installed to extend above the fixing portion 110 and the at least one speaker 161 installed on the auxiliary speaker mounting member 160 or 160' may implement a multi-channel sound system by receiving and outputting a multi-channel sound signal from a sound source (home theater, TV, set-top box, sound bar, computer, cellular phone, tablet PC, or the like) provided inside or outside the chair.

In still another embodiment, the one end of the auxiliary speaker mounting member 160 or 160' may be hinge-pivotably installed on the fixing portion 110 like the third speaker mounting member 150.

In this case, when the user sits in or rises from the chair 1000, a direction of the auxiliary speaker mounting member 160 or 160' may be adjusted not to interfere. In another case, a direction of the auxiliary speaker mounting member 160 or 160' may be manually adjusted by the user or be autonomously adjusted through an additional algorithm so as to create further optimized and customized sound environments while the user sits in the chair.

The backrest portion 200 is a part configured to support the back, waist, and side parts of the user who sits in the chair 1000 and in which a front or inside (that is, a part which comes into contact with the back, waist, and side parts of the user) may be formed of a cushioning material or have a cushioning material added thereon for comfort of the user.

Also, at least one speaker 201 may be installed in one area of a front or inside 200*a* of the backrest portion 200. Preferably, in order to prevent the speaker 201 from coming into direct contact with the user who sits in the chair 1000, the speaker 201 may be inserted into and installed in the backrest portion 200 not to be exposed. Also, in addition, a control portion configured to control the speaker 201 may be provided in one area of the chair 1000.

The speaker 201 installed in the inside 200*a* of the backrest portion 200 may be a woofer speaker. In the case of the woofer speaker, since the strength of generated vibration is high in comparison to a general speaker, it is preferable to install the woofer speaker in the backrest portion 200 or the seat portion 300. Also, since the vibration generated by the woofer speaker 201 may be transferred directly to the user who sits in the chair 1000, there is an advantage of providing a more vivid user experience.

Also, side bolster portions 210 and 220 formed to protrude toward the inside of the backrest portion 200 and configured to support side parts of the user who sits in the chair may be provided on both sides of the backrest portion 200.

Here, referring to FIG. 10, at least one speaker 211*a*, 211*b*, 221*a*, or 221*b* may be installed on an inside 210*a* of the side bolster portion 210 or 220.

Since it is possible to generate a sound at a bottom through the at least one speaker 211*a*, 211*b*, 221*a*, or 221*b* installed on the inside 210*a* of the side bolster portion 210 or 220, the user who sits in the chair 1000 may actually feel the sound generated from the bottom in an image or in game environments.

The seat portion 300 is a part configured to support at least a buttocks part and part of legs of the user who sits in the chair 1000 and in which a top (that is, a part which comes into contact with the buttocks part and part of legs of the user) may be formed of a cushioning material or have a cushioning material added thereon for comfort of the user. Also, although not separately shown in the drawings, at least one speaker may be installed in one area of the inside 200*a* of the seat portion 300. Preferably, in order to prevent the speaker from coming into direct contact with the user who sits in the chair 1000, the speaker may be inserted into and installed in the seat portion 300 not to be exposed. Also, in addition, a control portion configured to control the speaker may be provided in one area of the chair 1000.

The speaker installed inside the seat portion 300 may be a woofer speaker. In the case of the woofer speaker, since the strength of generated vibration is high in comparison to a general speaker, it is preferable to install the woofer speaker in the seat portion 300. Also, since the vibration generated by the woofer speaker may be transferred directly to the user who sits in the chair 1000, there is an advantage of providing a more vivid user experience.

Also, armrest portions 310 and 320 formed to protrude upward from the seat portion 300 and configured to support arm parts of the user who sits in the chair 1000 and auxiliary seat portions 330 and 340 configured to support part of legs of the user who sits in the chair 1000 may be provided on both sides of the seat portion 300.

At least one speaker 311 may be installed on an inside 310*a* of the armrest portion 310, which may be equally applied to the armrest portion 320 on an opposite side thereof. Also, at least one speaker 331*a* or 331*b* may be installed on an inside 330*a* of the auxiliary seat portion 330, which may be equally applied to the auxiliary seat portion 340 on opposite side thereof.

A binding cable 351 configured to restrict a movement range of the chair 1000 and a connection cable 361 configured to provide power and a sound signal to a multi-channel speaker installed in the chair 1000 may be installed in one area of the seat portion 300 (for example, one area of the auxiliary seat portion 340).

The binding cable 351 and the connection cable 361 may be connected to a binding portion 350 and a connection portion 360, respectively, but the present invention is not restricted thereto. The binding portion 350 and the connection portion 360 may be integrally provided, or the binding cable 351 and the connection cable 361 may be connected to any one of the binding portion 350 and the connection portion 360.

One end of the binding cable 351 may be fixed to the binding portion 350 while the other end of the binding cable 351 may be fixed to, for example, a desk or the like so as to restrict the movement range of the chair 1000. Accordingly, it is possible to prevent the connection cable 361 from being disconnected, to prevent the connection portion 360 in which one end of the connection cable 361 is installed from being damaged, or to prevent a connected part of a sound source (for example, a home theater, TV, set-top box, sound bar, computer, cellular phone, tablet PC, or the like) in which the other end of the connection cable 361 is installed from being damaged, due to excessive movement of the chair 1000 which exceeds a movable range of the connection cable 361.

Also, in another embodiment, the chair 1000 may wirelessly receive a sound signal at the multi-channel speaker installed in the chair 1000. In this case, the connection cable 361 configured to provide the sound signal to the multi-channel speaker installed in the chair 1000 may be omitted.

In this case, the chair 1000 may include a wireless reception portion (not shown) configured to wirelessly receive the sound signal at the multi-channel speaker installed in the chair 1000. The wireless reception portion may wirelessly transmit or receive sound signals with a sound source (for example, a home theater, TV, set-top box, sound bar, computer, cellular phone, tablet PC, or the like) using a method such as Wi-Fi, Bluetooth, digital enhanced cordless telecommunications (DECT), Li-Fi, AirPlay, wireless speaker and audio association (WiSA), and the like.

Here, the wireless reception portion may be provided on one side of the chair 1000 or provided in a speaker provided in the chair 1000.

According to the present invention, there is an advantage of changing a general chair to a chair in which a multi-channel sound system is implemented by installing a member for the chair in which the multi-channel sound system is implemented, in a headrest portion, a backrest portion, and/or a seat portion of the chair.

Also, since the member is integrally provided in the chair, there is an advantage of easily implementing the multi-channel sound system.

Also, in the multi-channel sound system implemented by the member, it is possible to implement sound environments optimized for a user by adjusting angles or the like of a plurality of speaker mounting member in which at least one speaker is installed.

Also, in an aspect that a chair in which the member is provided may also include a plurality of speakers, there is an advantage that the user can experience vivid sounds like those existing in actually reproduced images or game environments only by sitting in the chair. Particularly, since it is possible to transfer generated sounds to the user while the sounds are separated in a variety of directions such as frontward, rearward, sideward, upward, downward directions, and the like in reproduced images or game environments according to positions and the number of speakers provided in the chair, a true multi-channel sound system can be implemented.

What is claimed is:

1. A member for a chair, comprising:

a fixing portion;

a first speaker mounting member extending from the fixing portion through a left side of a user sitting on the chair to a front of the user and having a plurality of first speakers installed on a first surface facing the user; and a second speaker mounting member extending from the fixing portion through a right side of the user sitting on the chair to the front of the user and having a plurality of second speakers installed on a second surface facing the user, wherein the plurality of first speakers are positioned to be spaced at a first predetermined interval from each other, on the first surface facing the user, and the plurality of second speakers are positioned to be spaced at a second predetermined interval from each other, on the second surface facing the user, wherein an end of the first speaker mounting member and an end of the second speaker mounting member are located in front of the user and are spaced apart from each other, wherein at least one of the plurality of first speakers and at least one of the plurality of second speakers are located in front of the user, and output sound toward the user from the front of the user, wherein the plurality of first speakers and the plurality of second speakers are configured to receive a multi-channel sound signal and implement a multi-channel sound system, wherein the first speaker mounting member comprises a first slide space and first slide rails, and each first speaker of the plurality of first speakers are configured to be slidably movable toward a left or right of a first direction in which the first speaker mounting member extends, along the first slide rails, in the first slide space, and wherein the second speaker mounting member comprises a second slide space and second slide rails, and each second speaker of the plurality of second speakers are configured to be slidably movable toward a left or right of a second direction in which the second speaker mounting member extends, along the second slide rails, in the second slide space.

2. The member of claim 1, wherein each first speaker of the plurality of first speakers are configured to be axially rotatable on the basis of an axis of each first speaker, that is perpendicular to the first direction, and wherein each second speaker of the plurality of second speakers are configured to be axially rotatable on the basis of an axis of each second speaker, that is perpendicular to the second direction.

3. The member of claim 1, wherein the first speaker mounting member and the second speaker mounting member are hinge-pivotably installed on the fixing portion.

4. The member of claim 1, further comprising:

at least one third speaker mounting member extending from the fixing portion through the top of the user sitting on the chair to the front of the user and having a plurality of third speakers installed on a third surface facing the user.

5. The member of claim 4, wherein the third speaker mounting member is hinge-pivotably installed on the fixing portion.

6. The member of claim 4, wherein at least one third speaker among the plurality of third speakers is installed to be slidably movable along a direction in which the third speaker mounting member extends.

7. The member of claim 4, further comprising at least auxiliary speaker mounting member provided in at least one area selected from a space between the first speaker mounting member and the third speaker mounting member and a space between the second speaker mounting member and the third speaker mounting member.

8. The member of claim 4, further comprising:

a plurality of third speakers each of which is positioned on an inner surface of the at least one third speaker mounting member, and the plurality of third speakers are positioned to be spaced at a third predetermined interval from each other, on the inner surface of the at least one third speaker mounting member.

9. The member of claim 1, further comprising a coupling portion configured to couple the fixing portion to the chair.

10. A chair comprising at least 1) a headrest portion configured to support a head part of a user, 2) a backrest portion configured to support a back and waist part of the user, and 3) a seat portion configured to support a buttocks part and part of legs of the user, the chair comprising a member for a chair, which is installed in at least one selected from the headrest portion, the backrest portion, and the seat portion, wherein the member comprises:

a fixing portion;

a first speaker mounting member extending from the fixing portion through a left side of a user sitting on the chair to a front of the user and having a plurality of first speakers installed on a first surface facing the user; and a second speaker mounting member extending from the fixing portion through a right side of the user sitting on the chair to the front of the user and having a plurality of second speakers installed on a second surface facing the user, wherein the plurality of first speakers are positioned to be spaced at a first predetermined interval from each other, on the first surface facing the user, and the plurality of second speakers are positioned to be spaced at a second predetermined interval from each other, on the second surface facing the user, wherein an end of the first speaker mounting member and an end of the second speaker mounting member are located in front of the user and are spaced apart from each other, wherein at least one of the plurality of first speakers and at least one of the plurality of second speakers are located in front of the user, and output sound toward the user from the front of the user, wherein the plurality of first speakers and the plurality of second speakers are configured to receive a multi-channel sound signal and implement a multi-channel sound system, wherein the first speaker mounting member comprises a first slide space and first slide rails, and each first speaker of the plurality of first speakers are configured to be slidably movable toward a left or right of a first direction in which the first speaker mounting member extends, along the first slide rails, in the first slide space, and wherein the second speaker mounting member comprises a second slide space and second slide rails, and each second speaker of the plurality of second speakers are configured to be slidably movable toward a left or right of a second direction in which the second speaker mounting member extends, along the second slide rails, in the second slide space.

11. The chair of claim 10, wherein the member is integrally provided with the headrest portion or the backrest portion.

12. The chair of claim 10, wherein the headrest portion replaces the fixing portion of the member, and wherein the first speaker mounting member and the second speaker mounting member are provided to extend from the headrest portion.

13. The chair of claim 10, wherein the backrest portion replaces the fixing portion of the member, and wherein the first speaker mounting member and the second speaker mounting member are provided to extend from the backrest portion.

14. The chair of claim 10, further comprising at least one third speaker mounting member provided to extend above the fixing portion and in which at least one speaker is installed.

15. The chair of claim 10, further comprising a coupling portion configured to couple the fixing portion to the chair.

16. The chair of claim 10, wherein each first speaker of the plurality of first speakers are configured to be axially rotatable on the basis of an axis of each first speaker, that is perpendicular to the first direction, and wherein each second speaker of the plurality of second speakers are configured to be axially rotatable on the basis of an axis of each second speaker, that is perpendicular to the second direction.

* * * * *